US006374464B1

(12) United States Patent
Lai

(10) Patent No.: US 6,374,464 B1
(45) Date of Patent: Apr. 23, 2002

(54) BUCKLE WITH FINE ADJUSTMENT MEANS

(76) Inventor: Chin-Kuo Lai, 9th fl, No. 2, Lane 72, Hsin-Hwa Road, Ping Chen City, Taoyuan Hsien (TW)

( * ) Notice: Subject to any disclaimer, the term of this patent is extended or adjusted under 35 U.S.C. 154(b) by 0 days.

(21) Appl. No.: 09/625,356

(22) Filed: Jul. 25, 2000

(51) Int. Cl.[7] ..... A43C 11/14
(52) U.S. Cl. ..... 24/68 SK
(58) Field of Search ..... 24/68 R, 68 SK, 24/70 SK, 70 ST, 69 ST, 69 SK, 71 ST, 71 SK, 68 A, 68 D, 68 E; 36/50.1, 50.5

(56) References Cited

U.S. PATENT DOCUMENTS

| | | | | |
|---|---|---|---|---|
| 3,662,435 | A | * | 5/1972 | Allsop |
| 5,416,952 | A | * | 5/1995 | Dodge |
| 5,606,779 | A | * | 3/1997 | Lu |
| 5,642,555 | A | * | 7/1997 | Lin |
| 5,745,959 | A | * | 5/1998 | Dodge |
| 5,779,259 | A | * | 7/1998 | Lin |
| 5,887,318 | A | * | 3/1999 | Nicoletti |
| 6,175,994 | B1 | * | 1/2001 | Nicoletti |

FOREIGN PATENT DOCUMENTS

| | | | | |
|---|---|---|---|---|
| EP | 400213 | A | * | 12/1990 |
| EP | 572373 | A1 | * | 12/1993 |
| FR | 2750832 | A1 | * | 1/1998 |
| JP | 8-242907 | | * | 9/1996 |
| JP | 10-23901 | | * | 1/1998 |
| WO | WO-98/41121 | A1 | * | 9/1998 |

* cited by examiner

*Primary Examiner*—James R. Brittain
(74) *Attorney, Agent, or Firm*—Bacon & Thomas, PLLC

(57) ABSTRACT

A buckle includes a casing of substantially U-shaped cross section. A toothed engagement strip is adapted for inserting into the casing. A locking plate is pivoted to the casing and turned at the locking position where the locking plate engages the teeth of the engagement strip to stop the engagement strip from backward movement relative to the casing and the unlocking position where the locking plate is disengaged from the teeth of the engagement strip for enabling the engagement strip to be removed from the casing. A fine adjustment handle is pivoted to the casing and adapted for turning by hand to move the engagement strip forwards relative to the casing after the engagement strip has been locked by the locking plate.

2 Claims, 4 Drawing Sheets

BUCKLE WITH FINE ADJUSTMENT MEANS

BACKGROUND OF THE INVENTION

The present invention relates to buckles, and more particularly to a buckle with fine adjustment means, which comprises a casing, a locking plate pivoted to the casing and turned to lock/unlock an engagement strip being inserted into the casing, and a fine adjustment handle pivoted to the casing and adapted to move the engagement strip forwardly relative to the casing after locking of the locking plate.

A regular shoe or roller skate buckle is generally comprised of a casing fixed to a first part of the shoe or roller skate, an engagement strip connected to a second part of the shoe or roller skate and adapted for inserting into the casing, and a locking plate pivoted to the casing and turned to lock/unlock the engagement strip. When locked, the position of the engagement strip cannot be adjusted relative to the casing. When adjusting the position of the engagement strip in the casing, the locking plate must be unlocked so that the engagement strip can be moved relative to the casing. Because no fine adjustment means is provided, it is complicated to accurately adjust the position of the engagement strip in the casing.

SUMMARY OF THE INVENTION

The invention has been accomplished under the circumstances in view. According to one aspect of the present invention, the buckle comprises a casing adapted to receive an engagement strip having a longitudinal series of teeth, a locking plate pivoted to the casing and turned to lock/unlock the engagement strip, and a fine adjustment handle pivoted to the casing and adapted for turning by hand to move the engagement strip forwards relative to the casing step by step after the locking plate has been set in the locking position to stop the engagement strip from backward movement. According to another aspect of the present invention, the locking plate comprises a vertical locking tooth downwardly disposed at a rear end thereof and adapted for engaging the teeth of the engagement strip, and two horizontal spring strips bilaterally backwardly disposed at a front end thereof, the spring strips each having a fixed front end integral with the locking plate and a free rear end stopped at a respective front stop plate at the vertical side walls of the casing for enabling the locking plate to be quickly returned to the locking position after each unlocking operation.

DETAILED DESCRIPTION OF THE PREFERRED EMBODIMENT

Figure 1:
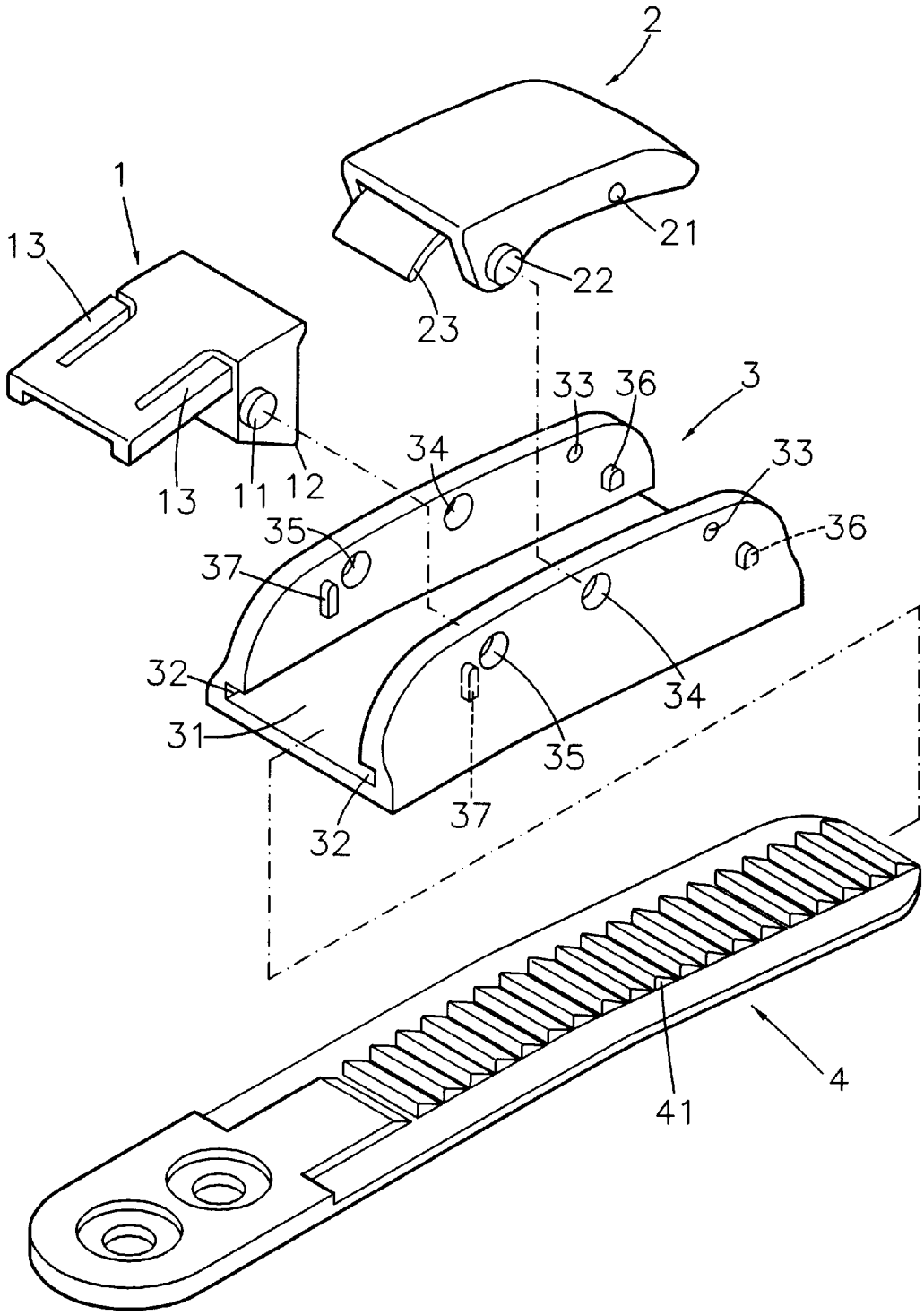
FIG. 1 is an exploded view of a buckle with fine adjustment means according to the present invention.

Referring to FIG. 1, a buckle in accordance with the present invention comprises a locking plate 1, a fine adjustment handle 2, a casing 3, and engagement strip 4. The locking plate 1 comprises two pivots 11 bilaterally disposed near the rear end thereof, a vertical tooth 12 downwardly disposed at the rear side, and two horizontal spring strips 13 bilaterally backwardly disposed at the front end thereof. The fine adjustment handle 2 is a flat, smoothly arched plate of substantially U-shaped cross section, comprising two pivots 22 bilaterally disposed near the front end thereof, two raised portions 21 bilaterally disposed near the rear end thereof, and an arched driving tongue 23 forwardly extended from the front end and curved downwards. The casing 3 is a U-shaped frame comprising a longitudinal passage way 31, two longitudinal sliding grooves 32 disposed along two opposite sides of the longitudinal passageway 31, two rear stop rods 36 respectively inwardly raised from two vertical side walls thereof near one end, namely, the rear end and aimed at each other, two locating holes 33 respectively formed on the two vertical side walls in front and above the elevation of the stop rods 36, two front stop rods 37 respectively inwardly raised from the vertical side walls near the other end, namely, the front end and aimed at each other, two first pivot holes 34 respectively formed on the vertical side walls and spaced between the locating holes 33 and the front stop rods 37, and two second pivot holes 35 respectively formed on the vertical side walls and spaced between the first pivot holes 34 and the front stop rods 37. The engagement strip 4 is flat, narrow, elongated strip 4 having a longitudinal series of teeth 41 arranged on one side wall, namely, the top side wall thereof and sloping in one direction.

Figure 2:
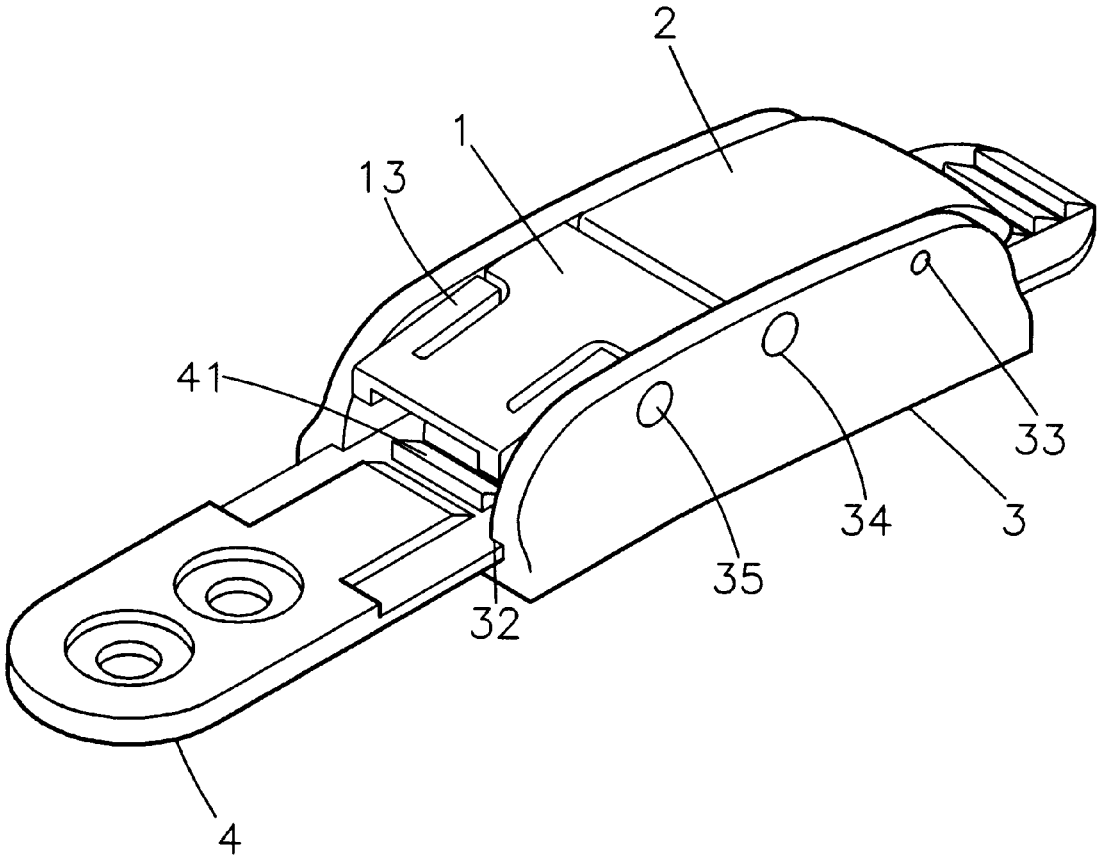
FIG. 2 is an assembly view of the buckle with fine adjustment means shown in FIG. 1.

Referring to FIG. 2 and FIG. 1 again, the pivots 11 of the locking plate 1 and the pivots 22 of the fine adjustment handle 2 are respectively coupled to the second pivot holes 35 and first pivot holes 34 of the casing 3, and then the engagement plate 4 is inserted into the sliding grooves 32 and moved axially forwards and backwards in the passageway 31 of the casing 3.

Figure 3:
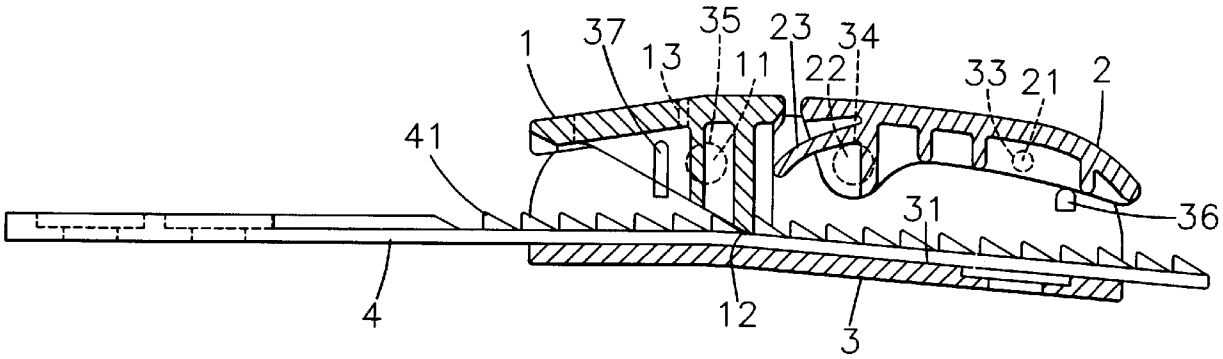
FIG. 3 is a side view in section of FIG. 2.
Figure 4:
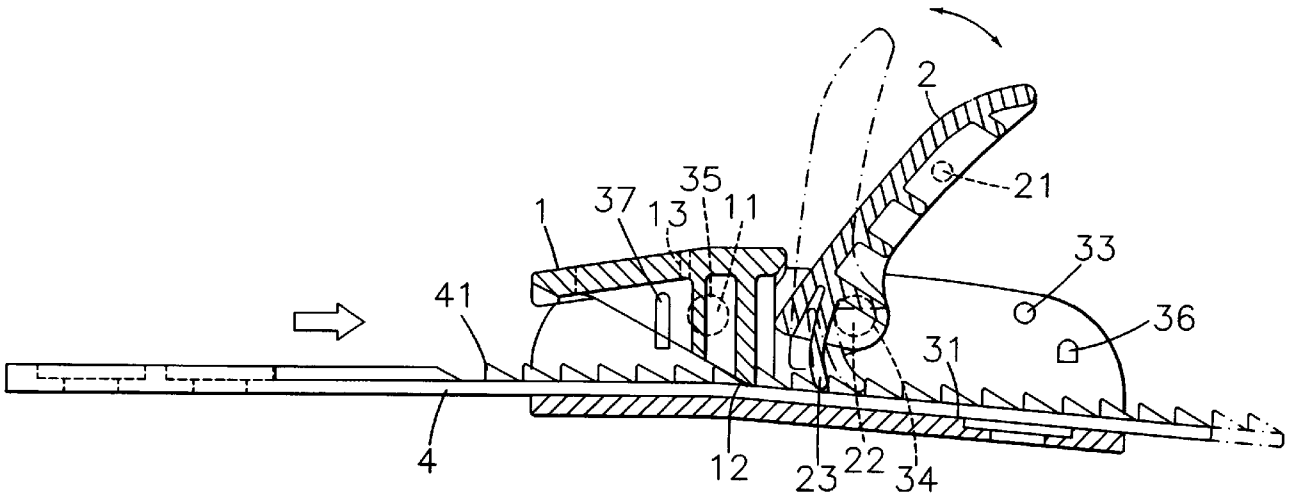
FIG. 4 is similar to FIG. 3 but showing the fine engagement handle turned clockwise, the engagement strip moved forwards relative to the casing.
Figure 5:
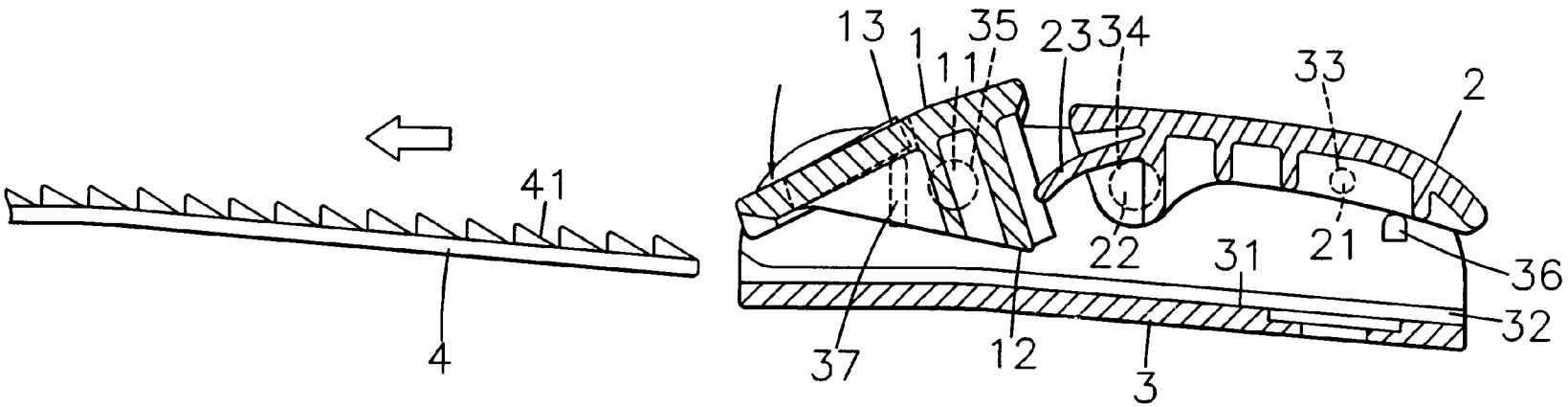
FIG. 5 is another sectional view of the present invention, showing the engagement strip disconnected from the casing.

Referring to FIGS. from 3 through 5 and FIG. 1 again, when inserting the engagement strip 4 into the passageway 31 in the casing 3, the teeth 41 of the engagement strip 4 is forced into engagement with the vertical tooth 12 of the locking plate 1, and the engagement strip 4 is stopped from backward movement relative to the casing 3 (see FIG. 3). When adjusting the position of the engagement strip 4 in the casing 3, the fine adjustment handle 2 is turned in clockwise direction relative to the casing 3, causing the driving tongue 23 of the fine adjustment handle 2 to push the engagement strip 4 forwards relative to the casing 3. When turning the fine adjustment handle 2 is the counter-clockwise direction, the driving tongue 23 is disengaged from the teeth 41 of the engagement strip 4. By means of continuously alternatively turning the fine adjustment handle 2 clockwise and counter-clockwise relative to the casing 3, the engagement strip 4 is continuously moved forwards relative to the casing 3. After adjustment, the fine adjustment handle 2 is turned counter-clockwise to force the raised portions 21 into engagement with the locating holes 33 of the casing 3, enabling the rear end of the fine adjustment handle 2 to be stopped at the stop rods 36 (see FIG. 4). When removing the engagement strip 4 from the casing 3, depress the front end of the locking plate 1 with the fingers to turn the locking plate 1 about an axis extended through the second pivot holes 35, and to disengage the downward tooth 12 from the teeth 41 of the engagement strip 4, enabling the engagement strip 4 to be pulled backwards and disconnected from the casing 3 (see FIG. 5). When depressing the front end of the locking plate 1, the spring strips 13 are respectively forced against the front stop rods 37 of the casing 3 to reserve energy. When releasing the fingers from the front end of the locking plate

1, the locking plate 1 is returned to its former position by the spring power of the spring strips 13.

While only one embodiment of the present invention has been shown and described, it will be understood that various modifications and changes could be made thereunto without departing from the spirit and scope of the invention disclosed.

What the invention claimed is:

1. A buckle comprising a casing of substantially U-shaped cross section, said casing having two vertical side walls, an engagement strip adapted for inserting into said casing between said vertical side walls, said engagement strip having a longitudinal series of teeth sloping in one direction, and a locking plate pivoted to said casing and turned about an axis between said vertical side walls between the locking position where said locking plate engages the teeth of said engagement strip to stop said engagement strip from backward movement relative to said casing and the unlocking position where said locking plate is disengaged from the teeth of said engagement strip for enabling said engagement strip to be removed from said casing;

wherein a fine adjustment handle is provided to said casing between said vertical side walls and adapted for turning by hand to move said engagement strip forwards relative to said casing after said engagement strip has been locked by said locking plate, said fine adjustment handle comprising an arched driving tongue forwardly extended from a front end thereof and adapted for driving the teeth of said engagement strip to move said engagement strip forwards relative to said casing; and wherein said locking plate comprises a vertical locking tooth downwardly disposed at a rear end thereof and adapted for engaging the teeth of said engagement strip, and two horizontal spring strips bilaterally backwardly disposed at a front end thereof, said spring strips each having a fixed front end integral with said locking plate and a free rear end stopped at a respective front stop plate at the vertical side walls of said casing.

2. A buckle comprising a casing of substantially U-shaped cross section, said casing having two vertical side walls, an engagement strip adapted for inserting into said casing between said vertical side walls, said engagement strip having a longitudinal series of teeth sloping in one direction, and a locking plate pivoted to said casing and turned about an axis between said vertical side walls between the locking position where said locking plate engages the teeth of said engagement strip to stop said engagement strip from backward movement relative to said casing and the unlocking position where said locking plate is disengaged from the teeth of said engagement strip for enabling said engagement strip to be removed from said casing;

wherein a fine adjustment handle is provided to said casing between said vertical side walls and adapted for turning by hand to move said engagement strip forwards relative to said casing after said engagement strip has been locked by said locking plate, said fine adjustment handle comprising an arched driving tongue forwardly extended from a front end thereof and adapted for driving the teeth of said engagement strip to move said engagement strip forwards relative to said casing;

wherein said fine adjustment handle comprises two raised portions bilaterally disposed near a rear end thereof and respectively engaged into a respective locating hole on the vertical side walls of said casing to hold said fine adjustment handle in a non-working position where said arched driving tongue is disengaged from the teeth of said engagement plate; and wherein said casing comprises two rear stop rods respectively raised from said vertical side walls and adapted to support the rear end of said fine adjustment handle.

* * * * *